US006224331B1

(12) United States Patent
Hayward et al.

(10) Patent No.: US 6,224,331 B1
(45) **Date of Patent: *May 1, 2001**

(54) CENTRIFUGAL PUMP WITH SOLIDS CUTTING ACTION

(75) Inventors: John Hayward, North York; Carlos Cohen, Toronto, both of (CA)

(73) Assignee: Hayward Gordon Limited, Mississauga (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/306,604

(22) Filed: May 6, 1999

Related U.S. Application Data

(63) Continuation-in-part of application No. 09/250,069, filed on Feb. 12, 1999.

(51) Int. Cl.[7] ..... F04D 29/52

(52) U.S. Cl. ..... 415/121.1; 415/169.1; 415/206

(58) Field of Search ..... 415/121.1, 121.2, 415/169.1, 206; 241/46.06, 46.08, 46.11, 185.6

(56) References Cited

U.S. PATENT DOCUMENTS

| | | | |
|---|---|---|---|
| 368,416 | 8/1887 | Mosher . | |
| 746,007 | 12/1903 | Brüncker . | |
| 2,012,568 | 8/1935 | Kiss . | |
| 2,201,947 | 5/1940 | Valentine . | |
| 2,236,706 | 4/1941 | Damonte . | |
| 2,646,974 | 7/1953 | Read . | |
| 2,978,233 | 4/1961 | Davey . | |
| 2,985,952 | 5/1961 | Nutter et al. . | |
| 3,013,501 * | 12/1961 | Ygge . | |
| 3,128,051 | 4/1964 | Smith | 241/46 |
| 3,155,046 | 11/1964 | Vaughan | 103/103 |
| 3,340,812 | 9/1967 | Schlesiger | 103/103 |
| 3,375,983 | 4/1968 | Von Eiff et al. | 241/46 |
| 3,447,475 | 6/1969 | Blum | 103/111 |

(List continued on next page.)

FOREIGN PATENT DOCUMENTS

| | | |
|---|---|---|
| 880252 | 6/1953 | (DE) . |
| 256486 | 8/1926 | (GB) . |
| 433618 | 8/1935 | (GB) . |

OTHER PUBLICATIONS

Allis–Chalmers Manufacturing Co, "Type SSOR Pumps", Bulletin 1643–B, Apr. 1937, pp. 3–7.

Tsurumi Manufacturing Co., Ltd., *Rugged Powerful Tsurumi Pumps for Perfect Sewage and Waste Water Control, C Series.*

*Primary Examiner*—Edward K. Look
*Assistant Examiner*—James M McAleenan
(74) *Attorney, Agent, or Firm*—Baker & Daniels

(57) ABSTRACT

A centrifugal pump has an impeller rotatable by means of a drive shaft. The impeller has a plurality of radially extending vanes connected to a hub and a partial back shroud with sharpened leading edges. The pump has a pump casing with a back plate adjacent to the back side of the impeller. Spiral grooves on the back plate interact with the sharpened edges on the back shroud to aid in protecting the area between the back plate and the impeller by cutting of solids and expulsion of solids through an output port. Cutting bars on the front plate of the casing project into the pump intake and interact with front edges of the vanes to cut incoming solids in a liquid mixture. A preferred form of impeller has vanes with sharpened leading edges that extend in a generally radial plane. These vanes sweep backwardly from their leading edges and each vane is given a double twist between the leading edge and its trailing edge. This form of impeller has both an effective slicing action and an efficient transmission of kinetic energy to the fluid.

20 Claims, 7 Drawing Sheets

U.S. PATENT DOCUMENTS

| | | | | |
|---|---|---|---|---|
| 3,953,150 | * | 4/1976 | Onal | 416/184 |
| 3,973,866 | | 8/1976 | Vaughan | 415/121 B |
| 3,989,406 | | 11/1976 | Bliss . | |
| 4,143,993 | | 3/1979 | Blum | 415/121 B |
| 4,472,109 | | 9/1984 | Blum | 415/170 A |
| 4,778,336 | | 10/1988 | Hussain | 415/121 B |
| 4,842,479 | | 6/1989 | Dorsch . | |
| 5,076,757 | | 12/1991 | Dorsch | 415/110 |
| 5,242,124 | | 9/1993 | Latzel et al. | 241/46.11 |
| 5,256,032 | | 10/1993 | Vaughan . | |
| 5,302,082 | | 4/1994 | Gilbert | 415/121.1 |
| 5,456,580 | | 10/1995 | Dorsch | 416/223 B |
| 5,460,482 | | 10/1995 | Dorsch | 415/121.1 |
| 5,549,451 | * | 8/1996 | Lyda, Jr. | 415/218.1 |
| 5,605,444 | * | 2/1997 | Paton et al. | 416/183 |

* cited by examiner

CENTRIFUGAL PUMP WITH SOLIDS CUTTING ACTION

This application is a continuation-in-part of U.S. patent application Ser. No. 09/250,069 filed Feb. 12, 1999.

BACKGROUND OF THE INVENTION

The present invention relates to centrifugal pumps, and in particular, pumps of this type that have a chopping or cutting capability.

A variety of centrifugal pumps are known currently which are capable of pumping liquids and slurries containing solid matter such as small pieces of garbage or other disposed items. These pumps have the capability of chopping or cutting solid matter in the liquid mixture permitting the output from the pump to be disposed of more readily.

U.S. Pat. No. 3,155,046 issued Nov. 3, 1964 to James E. Vaughan describes a centrifugal pump for pumping a mixture of liquid and stringy solid material that includes a housing with a peripheral wall having a discharge aperture therein, a closed end, and an open end. The pump has an impeller secured on a shaft and the impeller has radially disposed impeller blades. Edges of these vanes adjacent to the pump inlet co-operate with sharpened edges of pump inlet apertures to cut solid material entering the pump.

One pump known in the prior art is the ABS "Piranha" Grinder pump. This pump incorporates sharpened spiral cutting grooves on the inside of an intake plate of the pump. Front edges on the impeller vanes of the pump rotate against the grooves to produce a cutting action. The edges of the vanes are flat in profile. This pump design is susceptible to binding problems from material being wedged between the impeller edges and the intake plate.

Another known pump is the Vaughan chopper pump disclosed in U.S. Pat. No. 5,256,032 issued Oct. 26, 1993. Features to chop and expel material from behind the impeller of the pump are incorporated into the design. The pump incorporates elongated curved vanes of the impeller operating in close cutting relationship with axially protruding ribs on a back plate of the casing. The vanes of the pump produce a cutting action as they pass over the ribs on the back plate.

Yet another known centrifugal pump is the screw centrifugal pump which utilizes spiral grooves in the rear face of the impeller of the pump and on the back plate of the casing of the pump. The rotating groove in the rear of the impeller operates against the stationary grooves in the casing backplate providing the function of discharging solids from the space between the backplate and impeller of the pump.

A known Allis-Chalmers type "SSOR" pump designed especially for pumping paper stock in a paper mill employs an impeller that rotates in a pump casing having a frontal inlet and a side outlet. This known impeller has a partial back shroud and two vanes project forwardly from this back shroud. These vanes, which are twisted along their length, sweep backwardly from around a leading edge. This pump does not have any capability of chopping or cutting solids that enter the pump.

An object of the present invention is to provide a novel and durable centrifugal pump effective for pumping a mixture including solids suspended in a liquid.

A further object of the invention is to provide an efficient and reliable centrifugal pump having an improved impeller with radially extending vanes.

Preferably the present pump is provided with a radial partial back shroud with sharpened leading shroud edges that cooperate with grooves formed on a back plate of the pump casing. The sharpened shroud edges and the grooves interact to cut solids that have entered the pump through the intake port.

SUMMARY OF THE INVENTION

According to one aspect of the invention, a centrifugal chopper pump comprises a pump casing having a frontal intake port and a pump outlet in a side thereof and a rotatable drive shaft extending into the casing from a rear side of the casing. The drive shaft rotates about an axis of rotation in a preselected direction of rotation. An impeller is mounted on the drive shaft for rotation therewith. This impeller has a set of radially extending vanes and a generally radial back shroud joined to an elongate side edge of each vane. The vanes each have a sharpened leading edge that extends generally radially in relation to the axis of rotation. Each vane projects forwardly from the back shroud and sweeps backwardly from the leading edge relative to the direction of rotation to a trailing edge. Narrow elongate cross-sections of each vane taken in a series of consecutive axial planes as defined by the axis of rotation are rotated relative to one another from an initial cross-section near the leading edge that extends generally radially to a trailing cross-section adjacent the trailing edge which extends at a substantial angle to the initial cross-section. At least one cutter member is rigidly mounted on the pump casing and is located in the intake port. This cutting member has an inner edge that extends generally radially in relation to the axis of rotation. During operation of the pump, the leading edges of the vanes rotate closely past the at least one cutter member to cut incoming solid material caught between the leading edges of the vanes and the cutter member.

Preferably the impeller includes a central hub through which the drive shaft extends and both an inner side edge of each vane and the back shroud are rigidly connected to this hub.

According to another aspect of the invention, an impeller is provided for a centrifugal chopper pump having a frontal intake port formed in a casing of the pump and a drive shaft rotated about an axis of rotation. This impeller comprises a central hub connectible to the drive shaft for rotation in a predetermined direction and two or more similar vanes extending radially outwardly from the hub and connected thereto. Each vane has an elongate sharpened leading edge that extends generally radially in relation to the axis of rotation and each vane sweeps backwardly from this leading edge relative to the direction of rotation to a trailing edge. Each vane defines narrow, elongate vane cross-sections taken along various consecutive axial planes as defined by the axis of rotation. These consecutive cross-sections are rotated relative to each other from an initial elongate vane cross-section near the leading edge of the vane that extends generally radially to an elongate trailing cross-section adjacent the trailing edge. The latter cross-section extends at a substantial angle to the initial vane cross-section.

In the preferred embodiment, the pump casing includes an intake plate that forms the intake port and at least a portion of the inner sidewall of this intake plate has spiral grooves which interact with sharpened edges of the vanes to provide further cutting of solids entering the pump.

According to a further aspect of the invention, a centrifugal pump suitable for pumping a liquid mixture containing solids includes a rotatable drive shaft defining an axis of rotation, an impeller mounted on this drive shaft and a pump casing for forming a pump bowl that surrounds the impeller.

The impeller has radially extending vanes and a back shroud located at rear edges of these vanes. The shroud has cutouts located between adjacent vanes and forming leading shroud edges adapted for cutting the solids. The casing also forms an intake port adjacent to a front side of the impeller and a pump outlet. A back plate of the casing is located adjacent the back shroud and has cutting edges that extend at a substantial angle to the leading shroud edges that are adapted for cutting. These leading shroud edges and the cutting edges on the back plate closely interact to cut solids that have entered into the pump bowl.

Preferably the cutting edges on the back plate are formed by at least one spiral shaped groove formed on an inner surface of the back plate.

In a preferred embodiment of the pump, a disintegrator is mounted on the end of the drive shaft to provide initial cutting of solids as they enter the pump through the intake port.

Further features and advantages will become apparent from the following detailed description of a preferred embodiment, taken into conjunction with the accompanying drawings.

DETAILED DESCRIPTION OF PREFERRED EMBODIMENT

Figure 1:
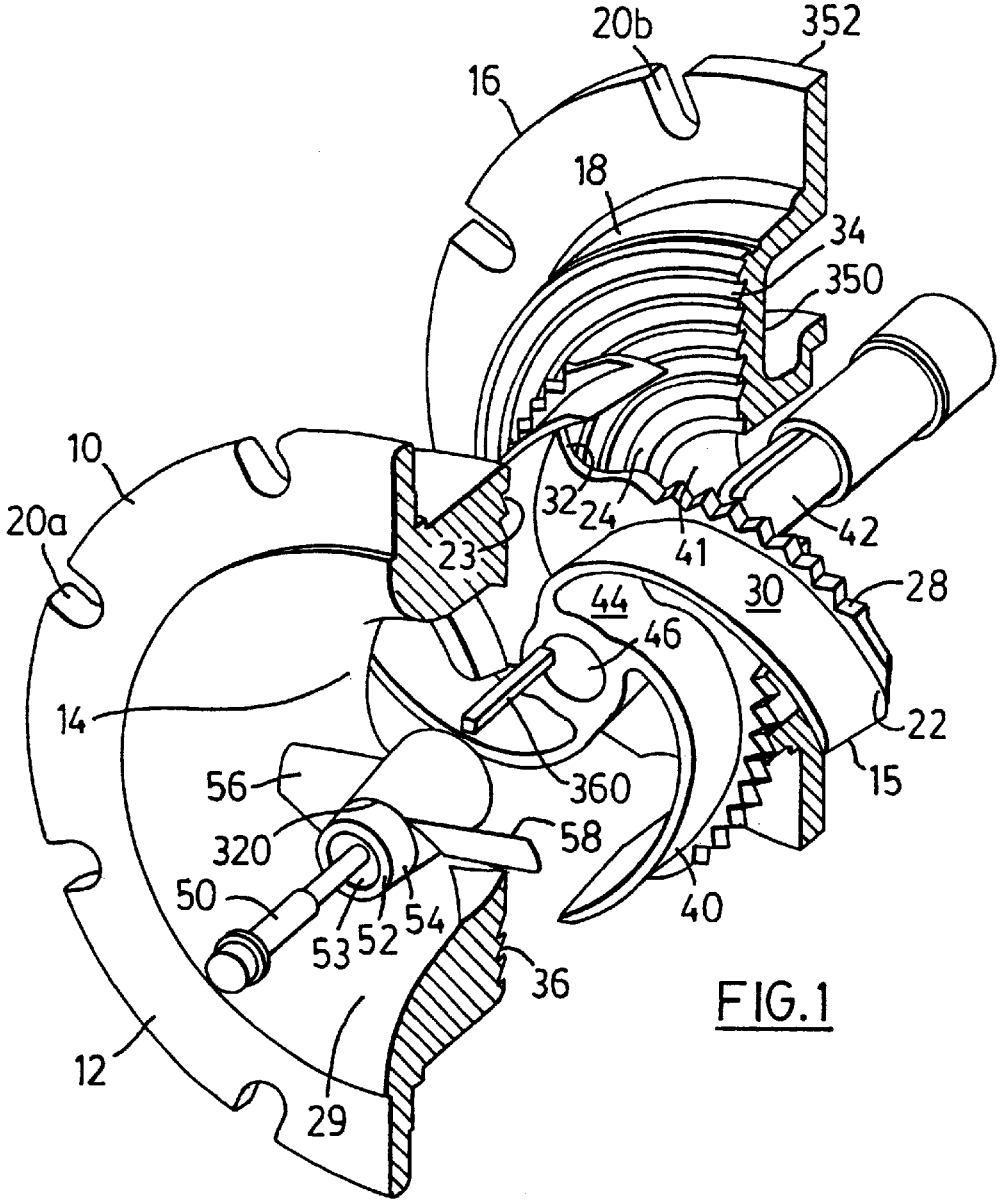
FIG. 1 is an exploded perspective view showing major parts of the centrifugal pump and taken from the intake end, with some parts cutaway for illustration purposes.
Figure 2:
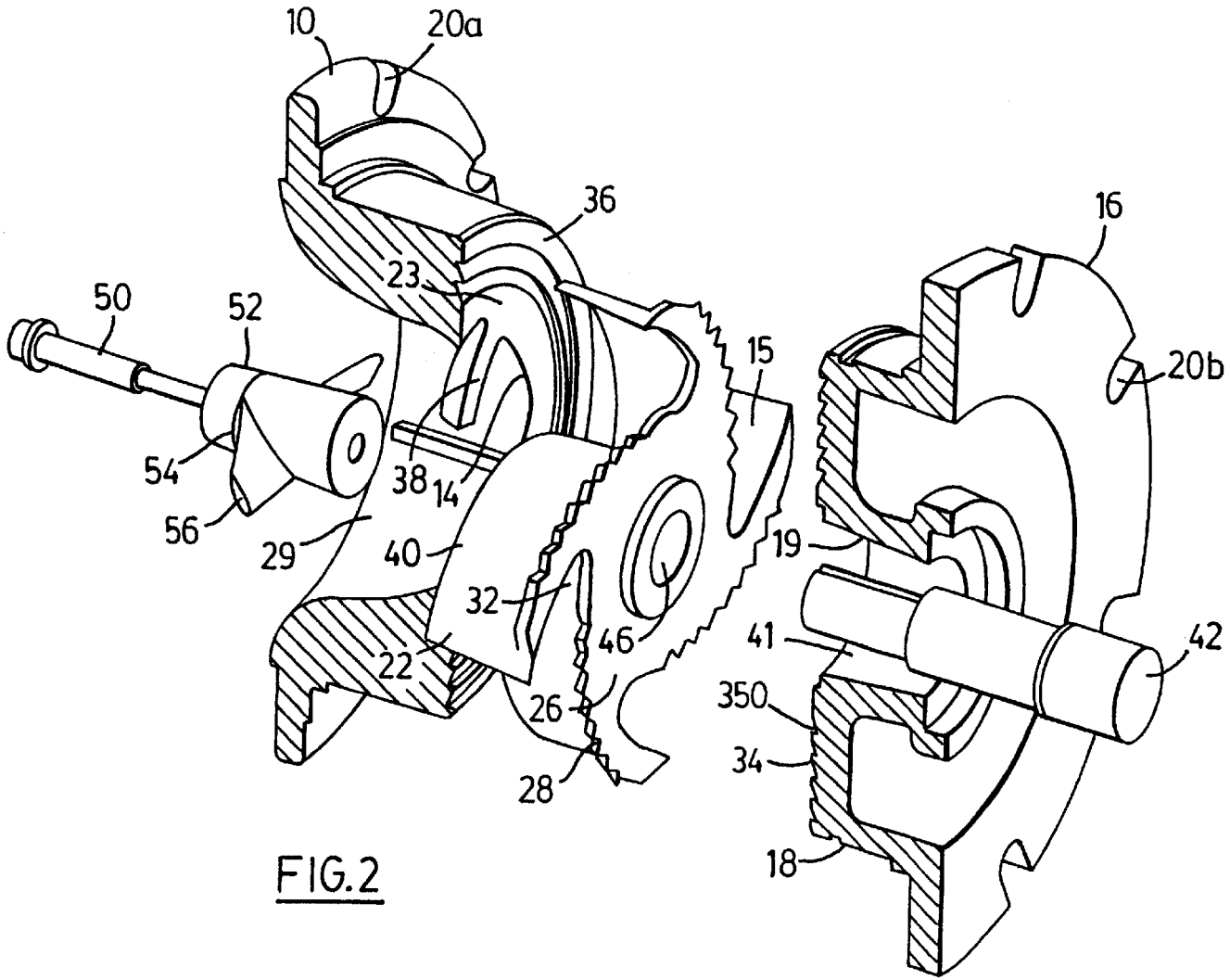
FIG. 2 is another exploded perspective view showing major parts of the centrifugal pump and taken from the side, again with some parts cutaway for sake of illustration.

FIGS. 1 and 2 of the drawings illustrate major parts of a centrifugal pump 12 in perspective. Further parts and features of this pump, which is a form of chopper pump, can be seen in FIG. 7. The major components of the pump include a central, rotatable drive shaft 42 that defines an axis of rotation extending along its central longitudinal axis. An impeller 22 is fixedly mounted on this drive shaft and this impeller has a set of radially extending vanes 30 with the illustrated impeller having four such vanes, each of which is curved from its inner end to its outer end. The impeller also has a generally radial, partial back shroud 26 with sharpened, leading shroud edges 28. Preferably these shroud edges are also beveled and serrated as shown. In the preferred illustrated embodiment, seven or eight teeth having a generally triangular shape provide the serrations between each pair of adjacent vanes. The vanes project generally forwardly from the back shroud towards an intake port 29 of the pump 12.

Figure 7:
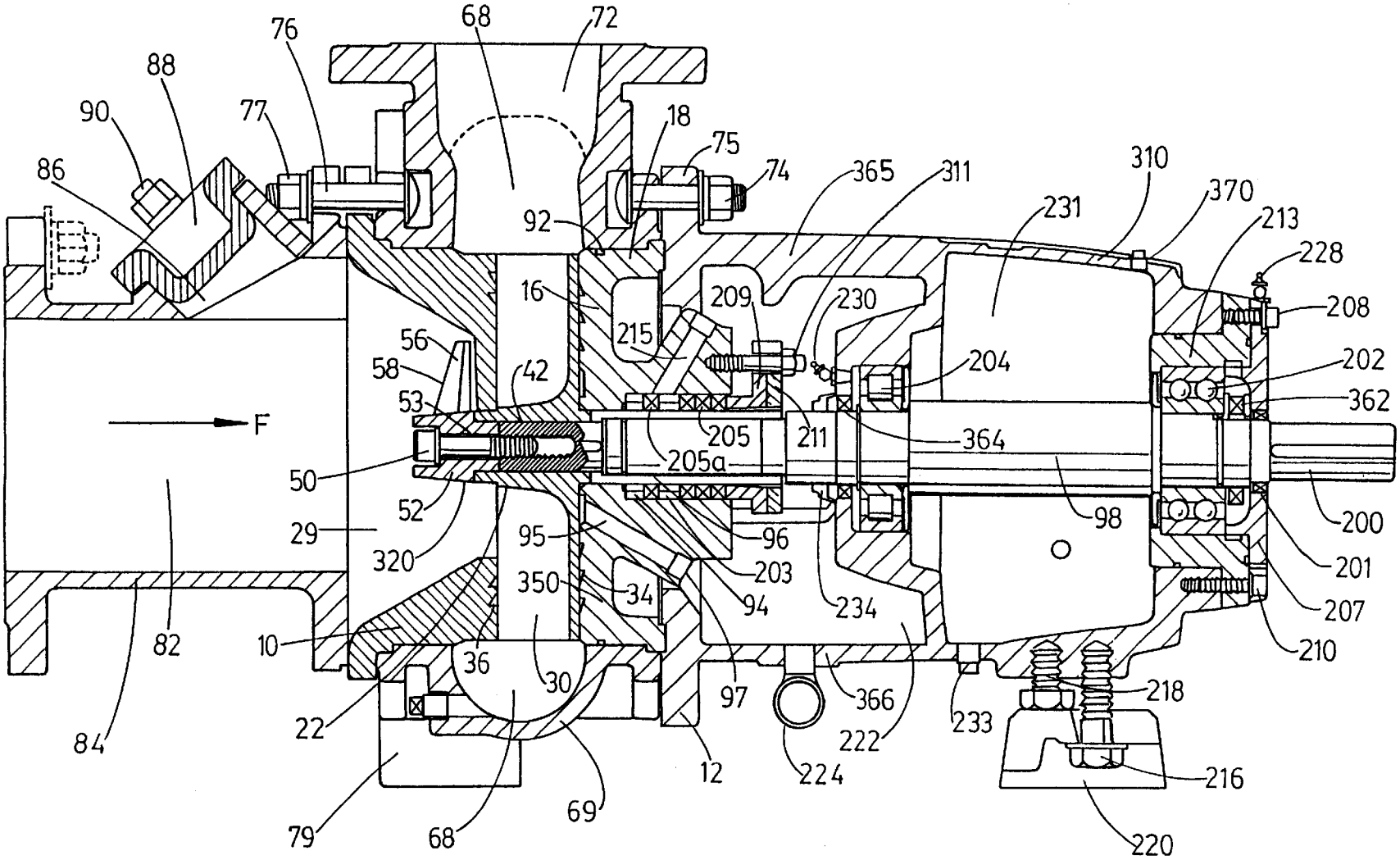
FIG. 7 is a cross-sectional view of a preferred form of centrifugal pump constructed in accordance with the invention.

The pump further includes a pump casing 69 that forms a bowl encircling the impeller in a manner known per se and illustrated in FIG. 7. It is the casing 69 that forms the intake port 29 adjacent to a front side of the impeller 22. Major components of the casing which are illustrated in FIGS. 1 and 2 are an intake plate 10 and a back plate 16, the latter being adjacent to the back shroud 26. The back plate is formed with spiral grooves 34 that face the back shroud. An important feature of the present pump is that the sharpened shroud edges 28 and the spiral grooves 34 interact to cut solids that have entered the pump 12 through the intake port. Preferably the spiral grooves 34 are outward threaded in the direction of rotation of the impeller 22 and extend circumferentially at least several times around the drive shaft 42. As a result of the direction of rotation of the vanes on the impeller and the outward thread of the grooves, any solids in these grooves tend to be expelled or are expelled from the grooves by the shroud edges as they rotate over these grooves.

Figure 3A:
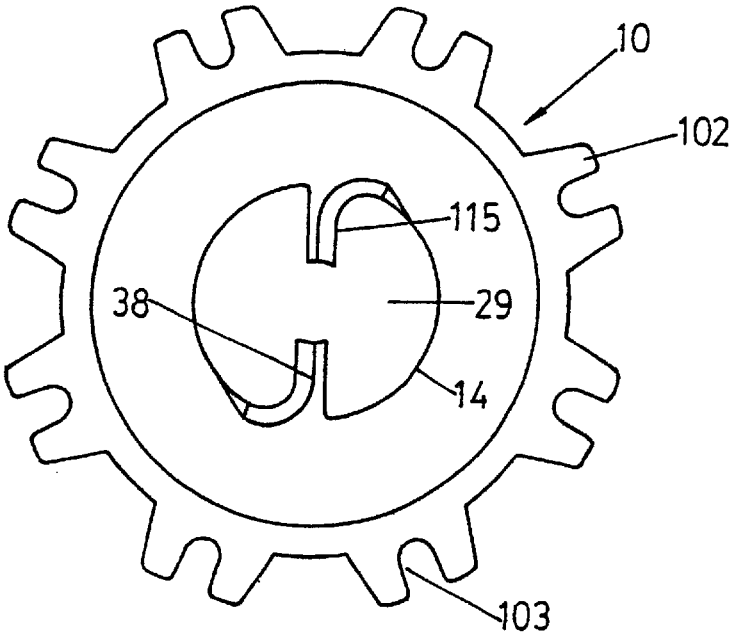
FIG. 3A is a front view of another embodiment for the intake plate for the pump.
Figure 3B:
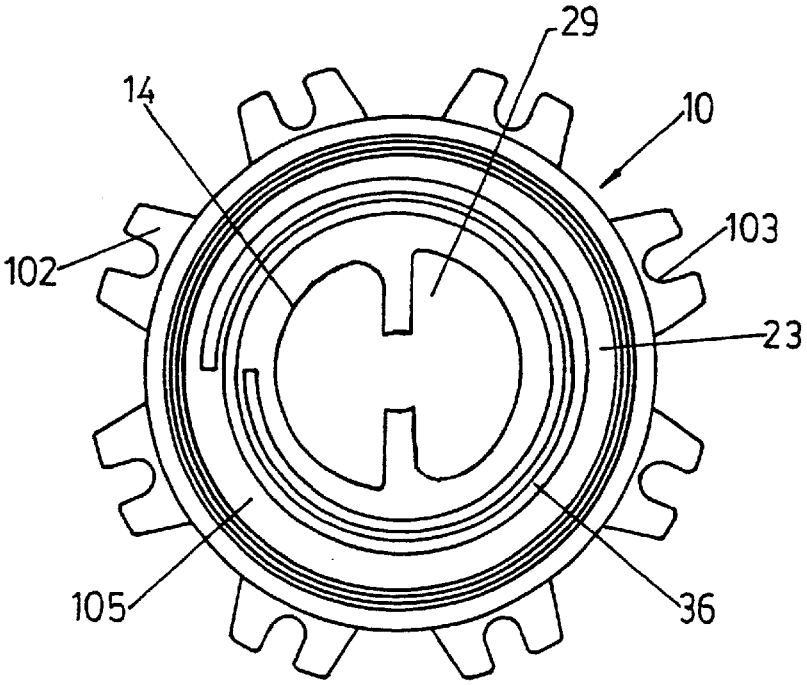
FIG. 3B is a back view of the embodiment of the intake plate illustrated in FIG. 3A.

The preferred form of intake plate 10 is shown in detail in FIGS. 3A and 3B. The inner region of this plate forms an intake cone in order to funnel the incoming liquid into the pump. Extending radially outwardly from the generally circular inner edge 14 is an inner side wall 23 forming one side of the pump bowl. The sidewall 23 thus extends radially outwardly from the input port. The preferred intake plate has eight connecting ears 102 as shown in FIGS. 3A and 3B with each ear having a single bolt receiving notch 103. In the alternate construction shown in FIGS. 1 and 2, the intake plate has a generally circular perimeter with no connecting ears. Eight notches 20*a* are formed in the perimeter of this version. Preferably, spiral shaped grooves 36 are formed on the inner sidewall 23 and extend circumferentially about the intake port 29. The sharpened front edges of the vanes 30 pass closely over these spiral grooves in order to provide additional cutting of solids in the liquid mixture during operation of the pump. In addition, radially inwardly projecting anvil ribs or bars 38 are integrally formed on the intake plate 10 and extend substantially into the intake port. These ribs are also swept closely by the front edges of the vanes 30 during pump operation in order to cut the solids in the liquid mixture that enters through the intake port. The beveled and sharpened front edge of the anvil ribs is indicated at 115.

Figure 4:
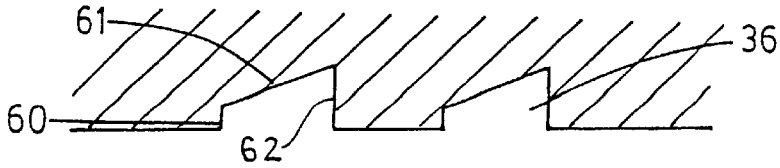
FIG. 4 is a sectional detail view showing the shape of the grooves formed in the back plate.
Figure 5:
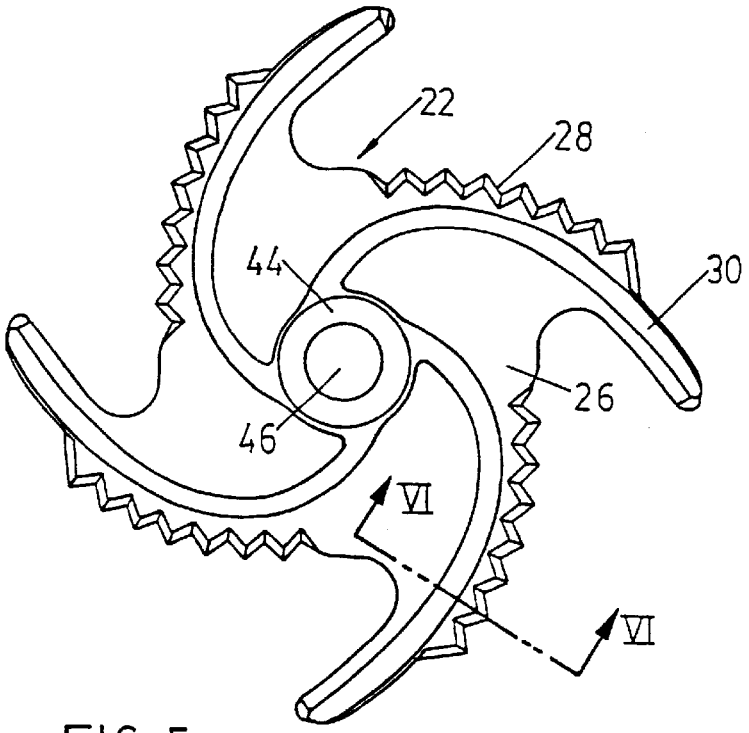
FIG. 5 is a front view of the impeller used in the centrifugal pump.
Figure 6:
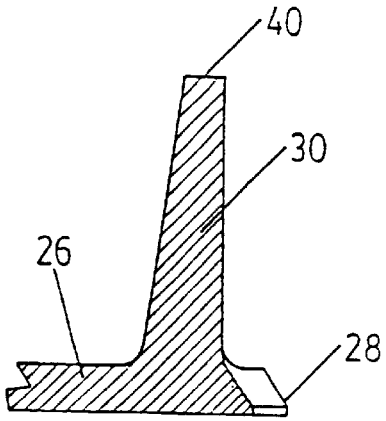
FIG. 6 is a cross-sectional view of one blade of the impeller, this view being taken along the line VI—VI of FIG. 5.

In one embodiment of the pump 12, the intake plate 10 as shown in FIGS. 3A and 3B has an outer diameter of 11 inches and an internal diameter at inner edge 14 of 5.25 inches. The depth of this intake plate is 3.75 inches. The radial cross-section of the spiral grooves 36 is illustrated in detail in FIG. 4. This cross-section is taken along an axial plane extending through the center axis of the drive shaft. The grooves 36 have opposing groove sides 60 and 62 and these are joined at the bottom of the groove by a sloping bottom 61. Thus, the side 62 is deeper than the radially outermost side 60. In one preferred embodiment, the side 60 has a depth of 0.13 inch while the side 62 has a depth of 0.23 inch.

Turning now to the construction of the preferred back plate 16, the cross-section of this plate is shown in detail in FIG. 7 with an alternate possible version being illustrated in FIGS. 1 and 2. The preferred back plate includes a cylindrical outer wall section 18 and a cylindrical inner wall section 19. These two cylindrical wall sections are connected by a radially extending wall section 350. In the back plate of FIGS. 1 and 2, there is a radially outwardly extending connecting flange 352 in which are formed a number of bolt receiving notches 20b. In the back plate of FIG. 7, there is no substantial connecting flange 352 but only a short annular outward projection which is received in a suitable annular recess formed about the bowl casing. The aforementioned spiral grooves 34 are formed on the inner surface of the wall section 350 and these grooves can have the same cross-section as the above described grooves 36. The grooves 34 provide cutting edges that extend at a substantial angle to the leading shroud edges 28 that are adapted for cutting. The cutting edges of the back plate extend in a generally circumferential direction around the back plate 16. It will also be noted that the inner wall section 19 forms a round aperture 41 for the drive shaft 42. The shaft extends through this aperture and through a round aperture 46 formed in the hub 44 of the impeller. A key 360 can be used to secure the impeller on the shaft, thereby preventing relative rotation.

Figure 8:
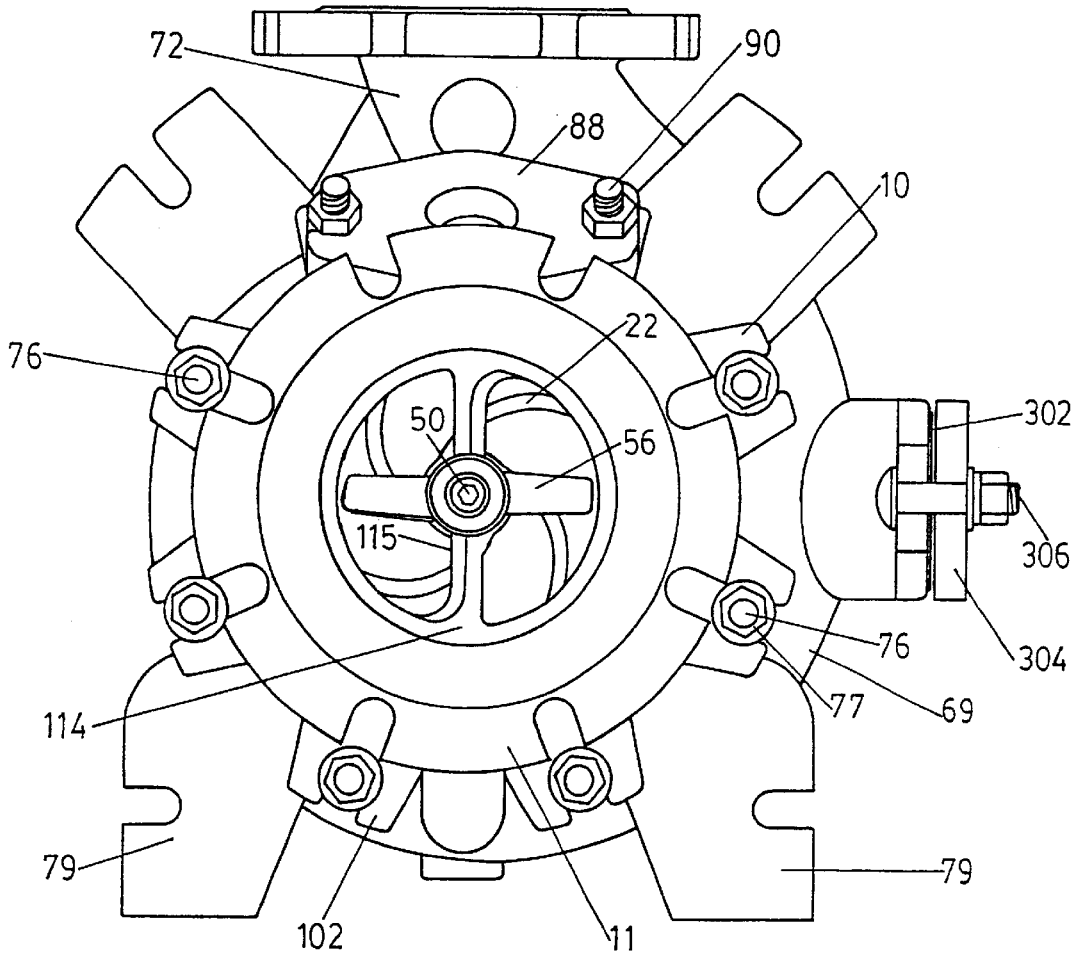
FIG. 8 is a front view of the centrifugal pump shown in FIG. 7.

Referring now to FIGS. 7 and 8 which illustrate a version of the centrifugal chopper pump, an output port 72 is provided for the pump on a top side thereof. It will be noted that a horizontal version of the chopper pump is illustrated but it is also possible for the pump to be constructed as a vertical pump wherein the drive shaft extends vertically. The pump bowl or chamber is indicated at 68 and this bowl is formed about its periphery by the pump casing 69 connected to both the intake plate 10 and the back plate 16. The bowl and its casing extend completely around the circumference of the impeller 22. Bolts 76 and nuts 77 are used to secure the intake plate 10 to the pump casing 69 by means of the aforementioned ears 102. There can also be attached to the front of the intake plate by means of the same bolts and nuts a short intake pipe 84 having a cylindrical intake passageway 82. The intake pipe 84 can be provided with a branch port 86 which is sealed by a removable cover 88 and is provided for suction inspection. The cover 88 can be held in place by two bolts 90 positioned at opposite ends thereof.

It will be understood that after the liquid mixture enters through the intake port 29, the liquid mixture is driven by the impeller 22 around the bowl 68 and out through the output port 72. A suitable discharge pipe can be connected to the port 72 if desired.

Attached to the rear side of the bowl casing is a relatively large oil reservoir and bearing support casing 310 on which is formed a connecting flange or connecting ears 75 at one end of the casing. Connecting bolts 74 and cooperating nuts (one of which is shown in FIG. 7) are used to secure the casing 310 to the bowl casing 69. By connecting the casing in this manner, the preferred back plate 16 is held in place by being clamped in a recess formed about the bowl casing. The liquid mixture which enters the pump in the flow direction indicated by the arrow F will not leak past the back plate because of an O-ring seal 92 that extends about the circumference of the back plate. The main function of the casing 310 is to support a pair of spaced apart bearings 202 and 204 that rotatably support the shaft in the casing. The outer bearings 202 are mounted in a bearing housing or sleeve 213 which is detachably connected to the casing 310 by bolts 210, one of which is shown. At the outer end of the housing 213 is a bearing cap 207 which is attached to the housing 213 by suitable bolts 208. Located on the opposite side of the large cavity 231, which can be filled with lubricating oil, is the roller bearing 204. The two bearings 204 and 206 can either be lubricated with the oil in cavity 231 or by means of grease which can be supplied to the bearing 202 by means of grease nipple 228 and which can be supplied to the bearing 204 by means of grease nipple 230. As will be seen in FIG. 7, the shaft section 98 which extends between the two bearings is enlarged and this helps to hold the bearings in place.

A shaft extension 200 extends outside of the casing 310 and this extension can be connected to a pump motor (not shown). Surrounding the base of the shaft extension 200 is a lip seal 201. The rear side of the bearing 202 is held in place by means of a bearing lock nut 362. Located on the pump side of the bearing 204 is a lip seal 364 which is covered by a V-ring 234 that is mounted on the shaft. Also mounted around the shaft and within the back plate structure are packing rings 205 of which there can be several. Located between a forward packing ring 205A and several other packing rings is a lantern ring 203 and located above this ring is a flush connection or passageway 215. When not being used for flushing, the passageway 215 can be closed at its outer end by a suitable plug. The lantern ring, in a known manner, has a number of holes for the purpose of providing water lubrication in the region of the packing ring by water entering through the connection 215. Mounted next to the rear packing rings are a gland follower 209 and a gland plate 211, these being connected to the inner cylindrical wall of the back plate by means of bolts 311, one of which is shown. Also shown in FIG. 7 is an optional impeller flush connection 95 formed in the back plate structure. This passageway is normally closed by means of a plug at 97 when not being used for flushing purposes.

An open space or region 222 surrounds a central section of the shaft 42. Extending across the top of this region is a connecting bar 365 which can act as a handle for the pump. Extending across the bottom of the region 222 is a connecting plate 366 which can be rounded about the bottom side of the shaft to form a dish or trap to catch any liquids in this region. These liquids can drain through a drain 224 connected to the plate 366.

It will be understood that if the cavity 231 is filled with lubricating oil, then grease is not required to lubricate the bearings 204 and 202 and the illustrated grease nipples 228 and 230 are not required. This lubricating oil can be drained from the cavity through a hole in the bottom thereof by removing a drain plug 233. On the opposite side of the cavity 231 is a vent plug 370.

The illustrated horizontal chopper pump can rest on a suitable horizontal surface by means of feet provided at 79 and 220. Two integral feet 79 can be provided at the front end of the pump on opposite sides of the bowl casing 69. The rear portion of the pump can be supported by the foot 220 which is detachably connected to the bottom of the casing 310. An adjusting bolt 218 can be used to adjust the relative height of this foot while a bolt or bolts 216 is used to connect the foot to the casing.

A disintegrator 52 can be optionally mounted on the front end of the drive shaft 42. This disintegrator is formed with a hub 320 having a central aperture 53. The preferred disintegrator has two generally radially projecting, diametrically opposed blades 56. The two blades are illustrated in FIGS. 1 and 2. These blades have edges 58 so that the disintegrator is able to cut solids in the incoming liquid mixture. The disintegrator can be attached to the front end of the shaft by means of a bolt 50 that extends through the aperture 53 and into a threaded hole formed in the front end section of the shaft. The disintegrator is located in the intake port 29, a short distance in front of the impeller.

It will thus be seen that the pump 12 described above is constructed so as to prevent the undesirable build up of dirt and contaminants in the space between the back shroud of the impeller and the back plate. In the past, dirt and contaminants have built up behind the back shroud of the pump causing damage and degradation to the shaft seals and the packing. This problem is reduced or eliminated with the described pump of this invention due to the cutting of solids in this region by the interaction between the spiral grooves 34 and the sharpened edges formed on the partial back shroud. Preferably the leading shroud edges are beveled and serrated for at least a substantial portion of their respective lengths resulting in a very good cutting action as these leading edges sweep over the spiral grooves.

Figure 9:
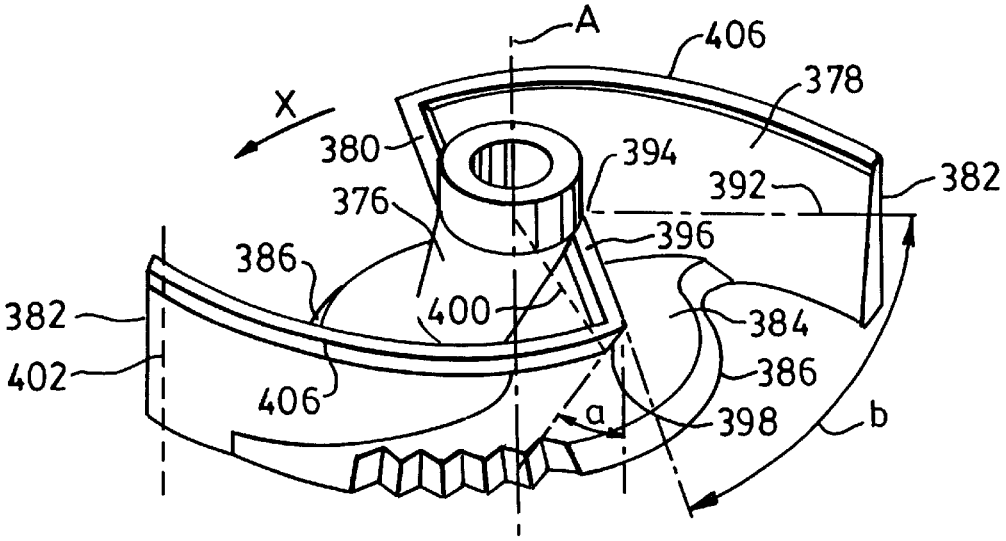
FIG. 9 is perspective view of an alternate form of an impeller that can be used in the centrifugal pump.

Illustrated in FIG. 9 is an improved, more efficient form of impeller 375 that can be used in the centrifugal chopper pump 12 of the invention. As with the first impeller, this impeller has a central hub 376 that is connectible to the above described drive shaft 42 for rotation in a predetermined direction indicated by the arrow X in FIG. 9. Unlike impeller 22, this more efficient impeller as illustrated has two vanes 378 which preferably are identical in their construction and layout. It will be appreciated, however, that this impeller also can have more than two vanes if desired and could, for example, have four vanes like the first impeller. Each vane has an elongate, sharpened leading edge 380 that extends generally radially in relation to the axis of rotation indicated by the dashed line A. In the illustrated preferred embodiment, the leading edges 380 are straight and disposed in a radial plane that is perpendicular to the axis of rotation. It is also possible for the leading edges 380 to be curved in the radial plane, for example, convexly curved so as to curve backwardly relative to the direction of rotation. Each vane 378 sweeps backwardly from the leading edge 380 relative to the direction of rotation to a flattened trailing edge 382. As indicated in more detail below, these preferred vanes are bent or twisted in two direction resulting in a pump having a higher hydraulic efficiency (reduced power consumption during operation) and improved suction conditions (lower NPSH, reduced cavitation).

Figure 11:
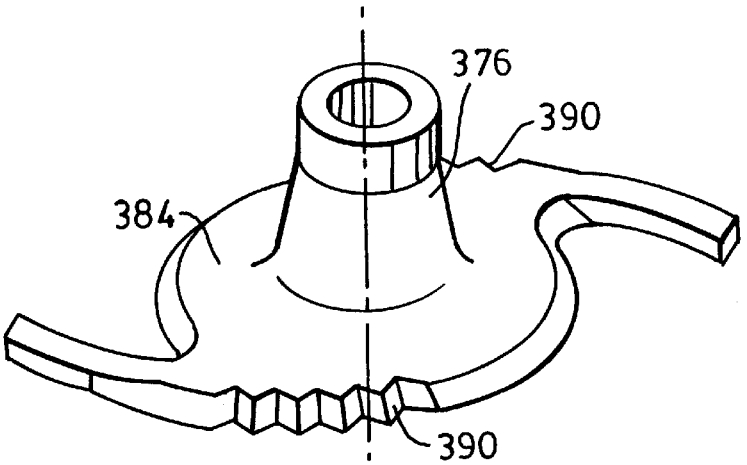
FIG. 11 is perspective view of the impeller of FIG. 9 with the two vanes removed to illustrate the construction of the hub and the partial back shroud.

The preferred impeller 375 has a back shroud 384 and, as in the first impeller, this shroud is preferably a partial shroud that is connected both to the hub 376 and to the vanes 378. The two vanes project forwardly from the back shroud and they can be integrally formed with the back shroud when the impeller is cast. The shroud 384 has sharpened circumferential edges at 386. As shown in FIG. 11, the back shroud extends completely around the central hub. Preferably the circumferentially extending edges of the back shroud are beveled and serrated with the serrations being provided on opposite sides of the hub at 390.

Returning to the configuration of the leading edge of each vane, the preferred straight leading edge of each vane is angled backwardly by an angle "b" that is about 30 degrees, from an axial plane indicated at 392 that extends through a meeting point 394 where the leading edge 380 of the respective vane meets the central hub. The indicated angle "b" is preferably a substantial acute angle but can be more or less than 30 degrees. Each leading edge 380 is formed by two flat surfaces 396 and 398 and these flat surfaces meet at a constant angle equal to 90 degrees minus angle "a", that in the preferred illustrated impeller is about 45 degrees. This sharp leading edge 380 is constructed to produce an excellent chopping and cutting action when it is rotated in close proximity past the two cutter bars or cutter members 38.

The unique design of the vanes 378 assures an effective slicing cutting action (by means of the sharp leading edges on the vanes) and efficient transmission of kinetic energy to the fluid and to the chopped material.

Figure 10:
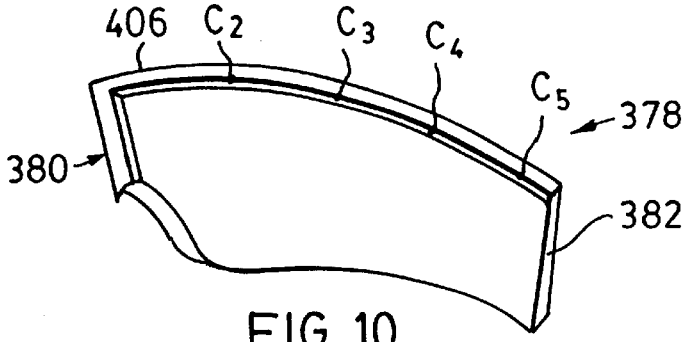
FIG. 10 is a perspective view taken from above of one of the vanes of the impeller of FIG. 9.

As illustrated in FIGS. 9 and 10, each vane 378 is generally thin throughout its length and width. As a result, cross-sections of each vane taken along a series of axial planes as defined by the axis of rotation A are generally narrow and elongate. Although the preferred illustrated vanes have narrow cross-sections which are substantially straight, it is also possible for the vanes 378 of the invention to have elongate cross-sections which are curved from the front to the back of the impeller. For the purpose of defining the twist in each vane, one can consider the position of an initial cross-section located along the line 400 shown in FIG. 9, this initial cross-section being taken near the leading edge 380 of the vane. This cross-section extends in a generally radial direction. Because of the twist in the vane, a trailing cross-section taken along the line 402 is rotated substantially relative to the cross-section taken at 400. The trailing cross-section 402 is adjacent the trailing edge 382 and it extends at a substantial angle not normally exceeding about 90 degrees to the initial cross-section. Furthermore, if one considers a number or series of intermediate cross-sections of the vane such as ones taken at points C2, C3, C4 and C5 indicated in FIG. 10, it will be apparent that there is a gradual rotation of the elongate consecutive cross-sections of the vane from a location near the leading edge to the trailing edge 382. It is the shaping of the impeller vanes in this manner that increases the performance of a chopper pump made with this type of impeller.

The impeller 375 can be manufactured using standard manufacturing techniques for pump impellers. The impeller can be made by casting and the sharpened edges can be made by standard machining processes.

It should be noted that not only is the leading edge 380 of each vane sharpened but also each vane has an elongate sharpened side edge at 406 that extends backwardly from the leading edge of the vane. It will be appreciated that this side edge lies closely adjacent the spiral grooves 36 formed on the inner sidewall of the intake cover. The sharpened side edge cooperates with these spiral grooves to provide additional solids cutting action similar to that provided with the first impeller.

Also, in the preferred illustrated vanes 378, the trailing edge 382 is elongate and substantially straight. It is also possible for the vane 378 to have a trailing edge which is curved from the front of the impeller to the back. As it will be apparent from FIG. 9, this trailing edge extends in a direction generally parallel to the axis of rotation A.

Various modifications and changes to the preferred centrifugal pump described herein will be apparent to those skilled in the art of making centrifugal pumps. Accordingly, all such modifications and changes as fall within the scope of the appended claims are intended to be part of this invention.

We claim:

1. A centrifugal chopper pump comprising:

a pump casing having a frontal intake port and a pump outlet in a side thereof;

a rotatable drive shaft extending into said casing from a rear side of the casing, said drive shaft rotating about an axis of rotation in a preselected direction of rotation;

an impeller mounted on said drive shaft for rotation therewith, said impeller having a set of radially extending vanes and a generally radial back shroud joined to an elongate side edge of each vane, said vanes each having a sharpened leading edge that extends generally radially in relation to said axis of rotation, each vane projecting forwardly from said back shroud and sweeping backwardly from said leading edge relative to said direction of rotation to a trailing edge, wherein narrow, elongate, cross-sections of each vane taken in a series of consecutive axial planes as defined by said axis of rotation are rotated relative to one another from an initial cross-section near said leading edge that extends generally radially to a trailing cross-section adjacent said trailing edge which extends to a substantial angle to said initial cross-section;

at least one cutter member rigidly mounted on said pump casing, located in said intake port, and having an inner edge that extends generally radially in relation to said axis of rotation, wherein, during operation of said pump, the leading edges of said vanes rotate closely past said inner edge of said at least one cutter member to cut incoming solid material caught between the leading edges of said vanes and said at least one cutter member.

2. A chopper pump according to claim 1 wherein said impeller includes a central hub through which said drive shaft extends and both an inner side edge of each vane and said back shroud are rigidly connected to said hub.

3. A chopper pump according to claim 2 wherein said leading edge of each vane is angled backwardly by a substantial acute angle from an axial plane extending through a point where the leading edge of the respective vane meets said central hub.

4. A chopper pump according to claim 2 wherein there are two vanes only on the impeller, there are two of said at least one cutter member, and the two cutter members are radially inwardly extending cutter bars.

5. A chopper pump according to claim 2 wherein said back shroud is a partial shroud that extends completely around said central hub and said trailing edge extends at a substantial angle not exceeding about 90 degrees to said initial cross-section.

6. A chopper pump according to claim 2 wherein said trailing edge of each vane is a straight elongate edge that extends in a direction generally parallel to said axis of rotation.

7. A chopper pump according to claim 5 wherein circumferentially extending edges of said back shroud are beveled and serrated.

8. A chopper pump according to claim 1 wherein said at least one cutter member is integrally formed on an intake cover of said pump casing, said intake cover having an inner radial surface facing said impeller and spiral grooves formed on said inside radial surface, and wherein each vane has a sharpened side edge extending backwardly from said leading edge of the vane and lying closely adjacent said spiral grooves with which it cooperates to provide additional solids cutting action.

9. An impeller for a centrifugal chopper pump having a frontal intake port formed in a casing of the pump and a drive shaft rotatable about an axis of rotation, said impeller comprising a central hub connectible to said drive shaft for rotation in a predetermined direction and two or more similar vanes extending radially outwardly from said hub and connected thereto, each vane having an elongate sharpened leading edge, that extends generally radially in relation to the axis of rotation, and sweeping backwardly from said leading edge relative to said direction of rotation to a trailing edge, wherein each vane defines narrow, elongate vane cross-sections taken along various consecutive axial planes as defined by said axis of rotation and these cross-sections are rotated relative to each other from an initial, elongate vane cross-section near said leading edge that extends in a generally radial direction to an elongate trailing cross-section adjacent said trailing edge which extends at a substantial angle to said initial vane cross-section.

10. An impeller according to claim 9 wherein said impeller includes a back shroud rigidly connected to both said hub and said vanes with said vanes projecting forwardly from the back shroud.

11. An impeller according to claim 10 wherein said shroud is a partial shroud with sharpened circumferential edges.

12. An impeller according to claim 10 wherein said leading edge of each vane is angled backwardly by a substantial acute angle from an axial plane extending through a meeting point where the leading edge of the respective vane meets said central hub.

13. An impeller according to claim 10 wherein said trailing edge is elongate and substantially straight and extends in a direction generally parallel to said axis of rotation.

14. An impeller according to claim 11 wherein said sharpened circumferential edges are also serrated along at least a portion thereof.

15. An impeller according to claim 12 wherein said leading edge of each vane is angled backwardly by an angle of about 30 degrees relative to said axial plane extending through the meeting point.

16. An impeller according to claim 10 wherein each vane has a sharpened side edge extending backwardly and radially outwardly from said leading edge of the vane.

17. A centrifugal pump suitable for pumping a liquid mixture containing solids, said pump comprising:

a rotatable drive shaft defining an axis of rotation;

an impeller mounted on said drive shaft for rotation therewith, said impeller having radially extending vanes and a back shroud located at rear side edges of said vanes, said shroud having cut-outs located between adjacent vanes and forming leading shroud edges adapted for cutting said solids; and a pump casing for forming a pump bowl, that surrounds said impeller, an intake port adjacent to a front side of said impeller, and a pump outlet, said pump casing including a back plate located adjacent said back shroud and having cutting edges that extend at a substantial angle to said leading shroud edges that are adapted for cutting, said drive shaft extending through said back plate, wherein said leading shroud edges and said cutting edges on the back plate closely interact to cut solids that have entered into said pump bowl.

18. A centrifugal pump according to claim 17 wherein said leading shroud edges are serrated and sharpened and said cutting edges on said back plate extend in a generally circumferential direction around said back plate.

19. A centrifugal pump according to claim 17 wherein each vane has an elongate sharpened leading edge, that extends generally radially in relation to the axis of rotation, and each vane sweeps backwardly from said leading edge relative to a predetermined direction of rotation of the impeller.

20. A centrifugal pump according to claim 19 wherein narrow, elongate cross-sections of each vane taken in a series of consecutive axial planes as defined by said axis of rotation are rotated gradually relative to one another from an initial cross-section near said leading edge that extends generally radially to a trailing cross-section adjacent said trailing edge which extends at a substantial angle not exceeding about 90 degrees to said initial cross-section.

* * * * *